US005547818A

United States Patent [19]

Lapp et al.

[11] Patent Number: 5,547,818

[45] Date of Patent: Aug. 20, 1996

[54] COLOUR PRINT MATERIAL WITH VARIABLE GRADATION

[75] Inventors: Otto Lapp, Bergisch Gladbach; Arno Schmuck, Leichlingen; Wolfgang Schmidt, Bergisch Gladbach; Jörg Siegel, Leverkusen, all of Germany

[73] Assignee: Agfa Gevaert AG, Germany

[21] Appl. No.: 333,078

[22] Filed: Nov. 1, 1994

[30] Foreign Application Priority Data

| | | | |
|---|---|---|---|
| Nov. 12, 1993 | [DE] | Germany | 43 38 649.0 |
| Feb. 22, 1994 | [DE] | Germany | 44 05 613.3 |
| Jul. 1, 1994 | [DE] | Germany | 44 23 129.6 |

[51] Int. Cl.[6] ..... G03C 1/46

[52] U.S. Cl. ..... 430/505; 430/506; 430/508; 430/544; 430/957; 430/555; 430/557; 430/944

[58] Field of Search ..... 430/505, 503, 430/506, 544, 543, 957, 553, 557, 944, 508

[56] References Cited

U.S. PATENT DOCUMENTS

| | | | |
|---|---|---|---|
| 5,021,332 | 6/1991 | Bergthaller et al. | 430/544 |
| 5,035,987 | 7/1991 | Odenwalder et al. | 430/544 |
| 5,051,345 | 9/1991 | Haraga et al. | 430/505 |
| 5,057,405 | 10/1991 | Shiba et al. | 430/505 |
| 5,270,157 | 12/1993 | Bell et al. | 430/505 |
| 5,360,703 | 11/1994 | Chang et al. | 430/506 |
| 5,372,920 | 12/1994 | Edwards | 430/505 |

*Primary Examiner*—Geraldine Letscher
*Attorney, Agent, or Firm*—Connolly & Hutz

[57] ABSTRACT

A color photographic print material with the usual three different sensitized silver halide emulsion layers and at least one silver halide emulsion layer containing no color coupler (control layer) with a spectral sensitization range outside the sensitization range of the image-producing layers, wherein the control layer contains a substance A, which, on negative development of the silver halide emulsion used in the control layer (control emulsion), releases a compound B which alters the gradation of the image-producing layers, is usable as a print material with variable gradation.

13 Claims, No Drawings

COLOUR PRINT MATERIAL WITH VARIABLE GRADATION

The present invention relates to a colour photographic print material with which, after exposure through a negative and negative processing, images of variable gradation may be obtained.

Manufacturers of colour photographic print materials currently offer them for sale in varying gradations, for example with flat gradation for portraits and similar images, with medium gradation for the majority of amateur photographs and with steep gradation for professional promotional photographs.

This situation is disadvantageous not only in that three materials of different composition must be produced, but also in that the grade of paper must frequently be changed in the printer or the printer must be arranged such that several cassettes with different materials may be accommodated.

A final disadvantage is that no more levels of gradation may be achieved than there are available grades of paper with differing gradation, continuous adjustment of gradation is thus not possible.

There is thus a requirement for a colour negative print material with variable gradation, in particular a colour negative paper with variable gradation.

Black-&-white papers with variable gradation have long been known (Ullmann's Encyclopedia of Industrial Chemistry, vol. A20, Photography, pp 138–139, VCH Verlagsgesellschaft mbH, D-6940 Weinheim, 1992).

The photosensitive layer of such black-&-white papers customarily contains, for example, a silver halide emulsion sensitive to blue light and a silver halide emulsion sensitive to blue and green light, which emulsions differ in gradation.

By systematically altering the copy light, the gradation of the image may be varied over a broad range. This process, known as the filter process, is restricted to black-&-white materials and cannot be transferred to colour materials as it would lead to extreme colour distortion in a colour material.

It is only for colour reversal materials that a method is known for the production of lower contrast prints (lower gradation) from very high contrast slides (steep gradation) by performing a generally subliminal pre-exposure without the image using white light and thereafter performing the customary exposure with the image and then subjecting the material to reversal development. The scope for changing gradation using this process is slight. The process is restricted to reversal materials and is usable only to reduce gradation (U.S. Pat. No. 4,021,831, EP 408 882).

The object of the present invention was to provide a colour print material with variable gradation and preferably a colour negative paper with variable gradation.

The object is achieved with a colour photographic print material which contains on a support at least one blue-sensitive silver halide emulsion layer containing at least one yellow coupler, at least one green-sensitive silver halide emulsion layer containing at least one magenta coupler and at least one red-sensitive silver halide emulsion layer containing at least, one cyan coupler, and which contains in at least one layer containing no colour coupler (control layer) a silver halide emulsion (control emulsion) sensitized differently to the blue-, green- or red-sensitized silver halide emulsions and a substance A, which, on colour negative development of the control emulsion, releases a compound B which alters the gradation of at least one layer containing colour coupler.

Print material is taken to be a material which, after exposure through a colour negative and negative processing, displays a positive image.

Its support may be transparent (display material) or reflective (colour negative paper).

The control emulsion and substance A may be arranged in a layer above all the layers containing colour coupler or in a layer below all the layers containing colour coupler (in each case starting from the support material) or in any desired interlayer.

The control emulsions and substance A may also be arranged in two or more layers containing no colour coupler.

The control emulsion and substance A are preferably arranged in the layers containing no colour coupler such that the gradation of all the layers containing colour coupler is altered in the same direction and to approximately the same extent.

Component B may act either to increase gradation or to decrease gradation. Development accelerators, for example, act to increase gradation, development inhibitors to decrease gradation. Accordingly, in one case substance A is, for example, a DIR compound and in the other case a DAR compound (DIR compound: development inhibitor releasing compound; DAR compound: development accelerator releasing compound).

DIR compounds will preferably be used in a material with high gradation and DAR compounds in a material with low gradation.

The substances A preferably have a reaction rate constant with the developer oxidation product of $K_{DOP} \geqq 30{,}000$ [l/mol·s]. This reaction rate constant is determined according to EP-A-0 537 545, pages 8 and 9.

The substances B preferably have diffusibility of $\geqq 0.4$. The method for determining this parameter is also contained in EP-A-0 537 545, pages 19 to 21.

Suitable compounds A are compounds of the formulae I and II:

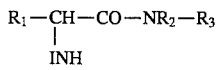

(I)

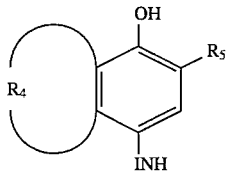

(II)

in which

INH means the residue of an inhibitor bonded via an N atom or via an S atom, preferably from the series of mono- or bicyclic triazoles or of mercapto-1,2,4-thiadiazoles, which residue is attached to the coupling site directly or via a time control member, $R_1$ means a residue $R_3$—CO—, $R_3$—$NR_2$—CO—, $R_6$CO—$NR_2$—$NR_2$—CO—,

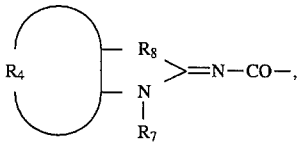

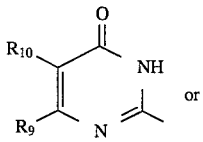

or

-continued

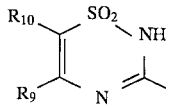

$R_2$ means hydrogen, alkyl, aralkyl, or alkylene attached to an adjacent aromatic residue, $R_3$ means an optionally substituted aromatic carbocyclic or heterocyclic residue, $R_4$ means the atoms necessary to complete an aromatic or heterocyclic residue, $R_5$ means a substituent with a Hammett constant $\sigma_{meta}$ of at least 0.1, preferably a carbonamido or carbamoyl group, $R_6$ means alkyl, aryl, aralkyl, alkoxy, alkylamino, arylamino or aralkylamino, $R_7$ means alkyl, aryl or aralkyl, $R_8$ means —$NR_2$— or —S—, $R_9$ and $R_{10}$ mean hydrogen, alkyl, aryl, alkoxy, alkylcarbonyl, arylcarbonyl, alkylsulphonyl, arylsulphonyl or together $C_3$–$C_5$ alkylene or the remaining members of an aromatic carbocyclic or heterocyclic ring.

Preferred compounds A are of the formula III

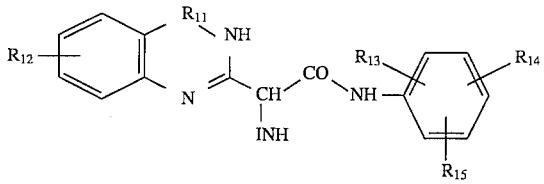

(III)

in which $R_{11}$ means —CO— or —$SO_2$—

$R_{12}$ means hydrogen, halogen, $C_1$–$C_4$ alkyl or $C_1$–$C_4$ alkoxy, $R_{13}$, $R_{14}$, $R_{15}$ mean hydrogen, halogen, alkyl, aryl, alkoxy, aryloxy, alkylthio, arylthio, sulphonamido, sulphamoyl, carbamoyl, acylamino, ureido, alkoxycarbonyl, acyloxy, aminocarbonyloxy or sulphonyl, wherein sulphonamido, sulphamoyl, carbamoyl, ureido, aminocarbonyloxy and sulphonyl are further substituted and at least one of the substituents $R_{13}$, $R_{14}$, $R_{15}$ is a ballast residue.

Examples of suitable compounds are:

DIR-1

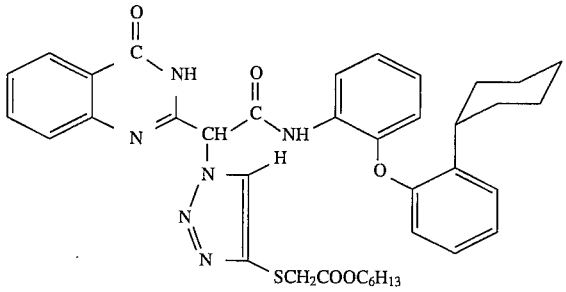

DIR-2

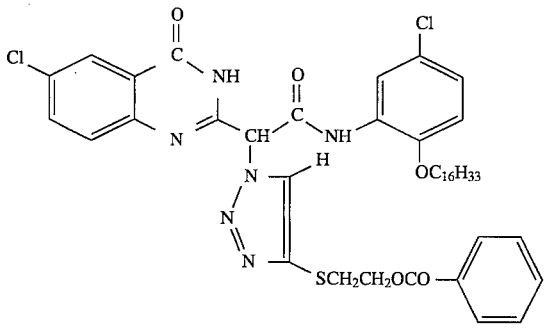

DIR-3

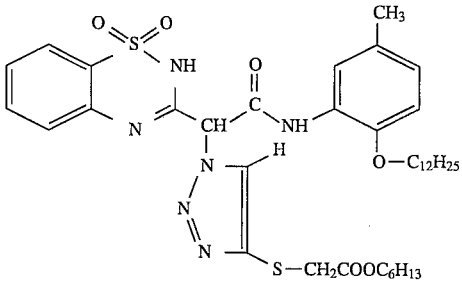

-continued
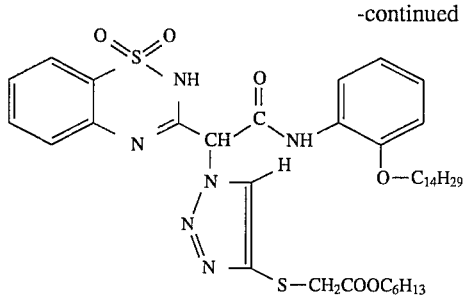
DIR-4
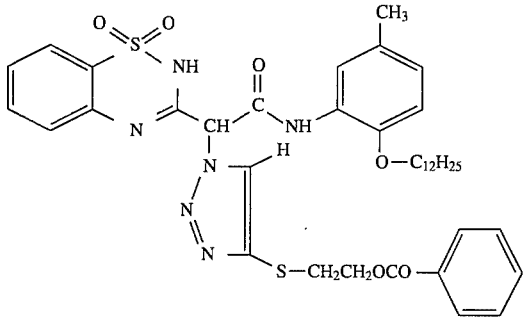
DIR-5
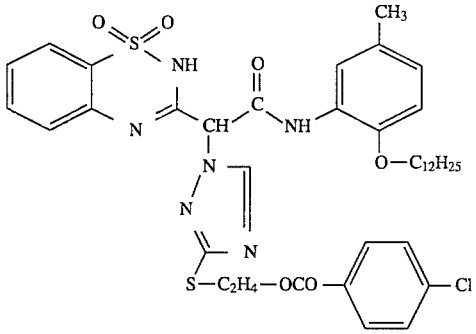
DIR-6
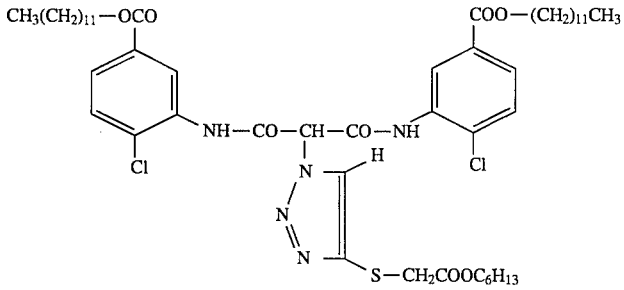
DIR-7
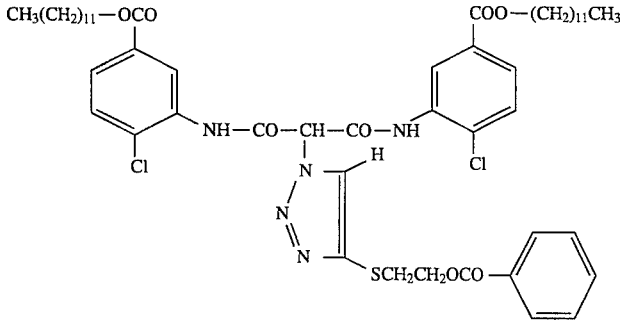
DIR-8

-continued

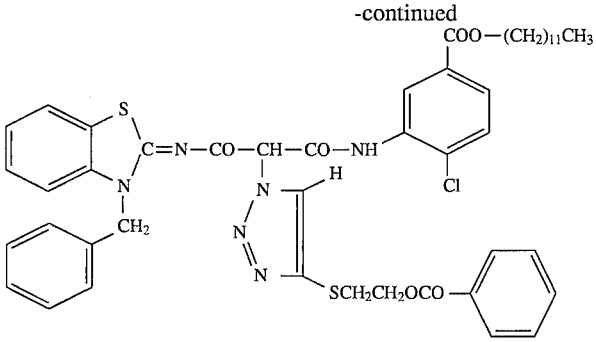

DIR-9

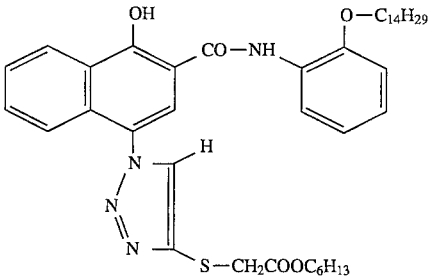

DIR-10

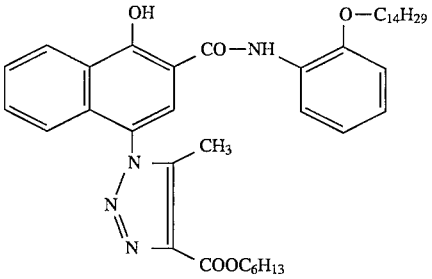

DIR-11

The control emulsion is preferably used in a quantity of 0.001 to 2.0 mmol/m$^2$ per control layer; compound A in a quantity of 0.0005 to 1.0 mmol/m$^2$ per control layer.

In particular, the control emulsion is used in a quantity of 0.05 to 1.0 mmol/m$^2$ per control layer; compound A in a quantity of 0.005 to 0.1 mmol/m$^2$ per control layer.

The material may in particular contain up to 4 control layers. The material preferably contains 3 control layers.

The control emulsion is preferably sensitized to the spectral range between green and red, i.e. for example to a range from 570 to 690 nm, preferably 580 to 680 nm, or to the infra-red range, i.e. for example to a range above 730 nm, preferably 740 to 800 nm. Appropriate sensitizers are known from the literature or may be produced using processes known from the literature.

Suitable spectral sensitizers for the range 570 to 690 nm belong, for example, to the following classes: benzothiazoletrimethinecyanines of the formula

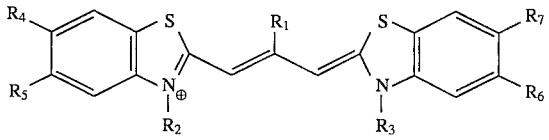

in which $R_1$ means $CH_3$, $C_2H_5$ $R_2$, $R_3$ mean $C_2H_5$, $(CH_2)_nSO_3$ n means 2, 3, 4

$R_4$, $R_5$, $R_6$, $R_7$ mean Cl, CN or $CH_3$ for example $R_1$=$CH_3$, $R_2$=$(CH_2)_3SO_3$, $R_3$=$(CH_2)_3$ $SO_3H$, $R_4$, $R_6$=Cl, $R_5$, $R_7$=H, $\lambda_{max}$=655 nm; S-1

$R_1$=$C_2H_5$, $R_2$=$(CH_2)_4SO_3$, $R_3$=$(CH_2)_4$—$SO_3H$, $R_4$, $R_6$=Cl, $R_5$, $R_7$= H, $\lambda_{max}$=650 nm; S-2

Naphthoxazolebenzothiazoletrimethinecyanines of the formula

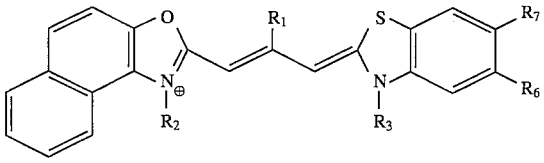

in which $R_1$, $R_2$, $R_3$, $R_6$, $R_7$ and n have the meaning stated above, for example $R_1$=$CH_3$, $R_2$=$(CH_2)_3SO_3$, $R_3$=$(CH_2)_3$ $SO_3H$, $R_6$=Cl, $R_7$=H, $\lambda_{max}$= 610 nm; S-3

$R_1$, $R_2$≦$C_2H_5$, $R_3$=$(CH_2)_4SO_3$, $R_6$ =Cl, $R_7$=H, $\lambda_{max}$=605 nm; S-4

Naphthothiazolebenzimidazoletrimethinecyanines of the formula

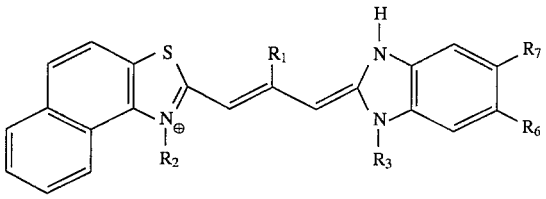

in which $R_1$, $R_2$, $R_3$, $R_6$, $R_7$ and n have the meaning stated above, for example $R_1=CH_3$, $R_2=(CH_2)_3SO_3$, $R_3=(CH_2)_3SO_3H$, $R_6$, $R_7$=Cl, $\lambda_{max}$=610 nm; S-5

$R_1=C_2H_5$, $R_2=(CH_2)_4SO_3$, $R_3=C_2H_5$, $R_6$, $R_7$=Cl, $\lambda_{max}$=605 nm; S-6

Naphthoxazolebenzoselenazoletrimethinecyanines of the formula

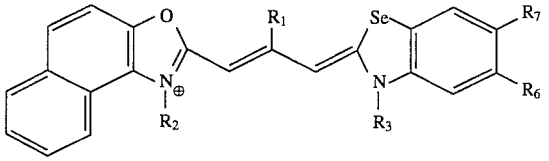

in which $R_1$, $R_2$, $R_3$, $R_6$, $R_7$ and n have the meaning stated above, for example $R_1=CH_3$, $R_2=(CH_2)_3SO_3$, $R_3=(CH_2)_3SO_3H$, $R_6=OCH_3$, $R_7=CH_3$, $\lambda_{max}$=620 nm; S-7

$R_1$, $R_2=C_2H_5$, $R_3=(CH_2)_3SO_3$, $R_6=OCH_3$, $R_7=CH_3$, $\lambda_{max}$=610 nm. S-8

Suitable spectral sensitisers for the infra-red range belong, for example, to the following classes:

Benzothiazolepentamethinecyanines of the formula

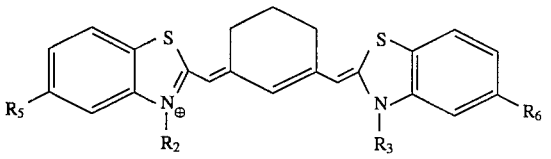

in which $R_2$, $R_3$, $R_5$, $R_6$ and n have the meaning stated above, for example $R_2$, $R_3=C_2H_5$, $R_5$, $R_6$=Cl, $\lambda_{max}$=750 nm; S-9

Naphthothiazolepentamethinecyanines of the formula

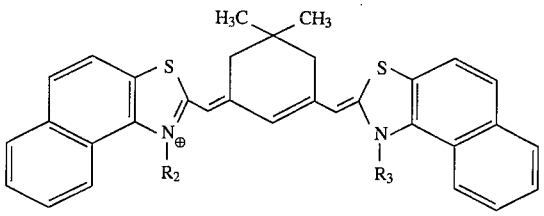

in which $R_2$, $R_3$ and n have the meaning stated above, for example $R_2=(CH_2)_3SO_3$, $R_3=(CH_2)_3SO_3H$, $\lambda_{max}$=760 nm; S-10

Naphthoselenazolepentamethinecyanines of the formula

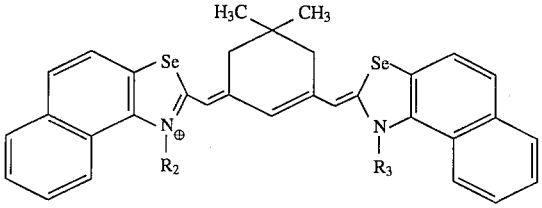

in which $R_2$, $R_3$ and n have the meaning stated above, for example $R_2$, $R_3=C_2H_5$, $\lambda_{max}$=765 nm. S-11

The absorption maxima were determined on spectrally sensitized $AgCl_{0.995}Br_{0.005}$ emulsions from example 2, 3rd, 5th or 7th layer.

Further suitable spectral sensitizers for the infra-red range belong to the following classes: benzothiazoleheptamethinecyanines, benzoxazolebenzothia-zoleheptamethinecyanines, benzoxazolehephthiazolehepta-methinecyanines, naphthiazoleheptamethinecyanines and benzoselenazoleheptamethinecyanines.

The control emulsion used is preferably a silver halide emulsion which may be developed very rapidly and which releases compound B from substance A by development and reaction with the developer oxidation product more rapidly than the silver halide emulsions of the layers containing colour coupler develop.

The control emulsion is preferably fine-grained (average grain size 0.05 to 1.0, preferably 0.1 to 0.4 μm) and preferably has a high chloride content (≧70 mol. % AgCl, in particular ≧95 mol. % AgCl).

Colour photographic silver halide materials are known containing a silver halide emulsion layer which contains no colour coupler. The silver halide emulsion of said silver halide emulsion layer is sensitive for a region of the visible light for which the image-producing layers are insensitive and said silver halide emulsion layer contains a DIR compound (DE 29 02 681, EP 167 173, DE 37 00 419). No print materials are disclosed but only colour films with camera sensitivity, wherein these means yield improvements with respect to sharpness, high colour density and pure colours. An influence of these means on gradation is not known from these references. According to the invention an influence on gradation is only obtained under specific conditions which are described below.

Commercially known print materials do not contain silver halide emulsion layers containing DIR compounds and being free from colour couplers.

Alteration of gradation is achieved with the material according to the invention by the material being exposed non-imagewise, before or after the imagewise exposure, with light of a wavelength within the spectral range to which the control emulsion is sensitive, and the imagewise exposure being performed with light which contains no fractions to which the control emulsion is sensitive. The different exposures may be performed by using appropriately filtered white light.

Exposure of the control emulsion may also be performed with a laser emitting light in the desired spectral range or other suitable light sources.

By varying the quantity of light in the spectral range to which the control emulsion is sensitive, the gradation of the three chromophoric layers may be continuously varied in the desired direction. The quantity of light is, for example, varied by altering the exposure time to the same light source. By varying the type and quantity of the DIR or DAR coupler in the control layer, gradation of the chromophoric layers may be further altered.

Suitable supports for production of the colour photographic materials are, for example, films and sheets of semi-synthetic and synthetic polymers such as cellulose nitrate, cellulose acetate, cellulose butyrate, polystyrene, polyvinyl chloride, polyethylene terephthalate and polycarbonate and paper laminated with a barytes layer or an α-olefin polymer layer (for example polyethylene). The surface of the support is generally subjected to a treatment in order to improve the adhesion of the photographic emulsion layer, for example to a corona discharge with subsequent application of a substrate layer.

The photographic emulsion layers (apart from the control layer) substantially comprise binders, silver halide grains and colour couplers.

Gelatine is preferably used as the binder. Gelatine may, however, be entirely or partially replaced with other synthetic, semi-synthetic or also naturally occurring polymers. Synthetic gelatine substitutes are, for example, polyvinyl alcohol, poly-N-vinyl pyrrolidone, polyacrylamides, polyacrylic acid and the derivatives thereof, in particular the copolymers thereof. Naturally occurring gelatine substitutes are, for example, other proteins such as albumin, chitosan, chitin or casein, cellulose, sugar, starch or alginates. Semi-synthetic gelatine substitutes are usually modified natural products. Cellulose derivatives such as hydroxyalkyl cellulose, carboxymethyl cellulose and phthalyl cellulose together with gelatine derivatives obtained by reaction with alkylating or acylating agents or by grafting polymerisable monomers, are examples of such products. The binders should have a sufficient quantity of functional groups available so that satisfactorily resistant layers may be produced by reaction with suitable hardeners. Such functional groups are in particular amino groups, but also carboxyl groups, hydroxyl groups and active methylene groups.

The preferably used gelatine may be obtained by acid or alkaline digestion. Oxidised gelatine may also be used. The production of such gelatines is described, for example, in The Science and Technology of Gelatine, edited by A. G. Ward and A. Courts, Academic Press 1977, pages 295 et seq. The gelatine used in each case should have a content of photographically active impurities which is as low as possible (inert gelatine). Gelatines with high viscosity and low swelling are particularly advantageous.

The silver halide present in the photographic material as the photosensitive constituent may contain chloride, bromide or iodide or mixtures thereof as the halide.

For example, the halide content of at least one layer may consist of 0 to 15 mol % iodide, 0 to 100 mol % chloride and 0 to 100 mol % bromide. The emulsions are preferably silver chloride-bromide emulsions with a chloride content of ≧95 mo. % up to pure silver chloride emulsions. The crystals may be predominantly compact, for example regularly cubic or octahedral or they may have transitional shapes. Lamellar crystals may, however, also be present, the average ratio of diameter to thickness of which is preferably at least 5:1, wherein the diameter of a grain is defined as the diameter of a circle the contents of which correspond to the projected surface area of the grain. The layers may, however, also have tabular silver halide crystals, in which the ratio of diameter to thickness is substantially greater than 5:1, for example 12:1 to 30:1.

The silver halide grains may also have a multi-layered grain structure, in the simplest case with one internal zone and one external zone of the grain (core/shell), wherein the halide composition and/or other modifications, such as for example doping, of the individual grain zones are different. The average grain size of the emulsions is preferably between 0.2 μm and 2.0 μm, in particular between 0.45 and 1.20 μm, the grain size distribution may be both homodisperse and heterodisperse. A homodisperse grain size distribution means that 95% of the grains do not deviate by more than ± 30% from the average grain size. The emulsions may, in addition to the silver halide, also contain organic silver salts, for example silver benzotriazolate or silver behenate.

Two or more types of silver halide emulsions which are produced separately may be used as a mixture.

The material according to the invention preferably contains a total quantity of silver halide, stated as the equivalent quantity of $AgNO_3$, of at most 1 g/m$^2$, in particular 0.6 to 0.8 g/m$^2$.

The photographic emulsions may be produced by various methods (for example P. Glafkides, Chimie et Physique Photographique, Paul Montel, Paris (1967), G. F. Duffin, Photographic Emulsion Chemistry, The Focal Press, London (1966), V. L. Zelikman et al., Making and Coating Photographic Emulsion, The Focal Press, London (1966)) from soluble silver salts and soluble halides.

The silver halide emulsions are generally subjected to chemical sensitization under defined conditions—pH, pAg, temperature, gelatine concentration, silver halide concentration and sensitizer concentration—until the optimum sensitivity and fog are achieved. The procedure is described in, for example, H. Frieser, Die Grundlagen der Photographischen Prozesse mit Silberhalogeniden, pages 675–734, Akademische Verlagsgesellschaft (1968).

Chemical sensitization may here proceed with the addition of compounds of sulphur, selenium, tellurium and/or compounds of metals of subgroup VIII of the periodic table (for example gold, platinum, palladium, iridium), furthermore there may be added thiocyanate compounds, surface-active compounds, such as thioethers, heterocyclic nitrogen compounds (for example imidazoles, azaindenes) or also spectral sensitizers (described, for example, in F. Hamer, The Cyanine Dyes and Related Compounds, 1964, or Ullmanns Encyclopädie der technischen Chemie, 4th edition, volume 18, pages 431 et seq, and Research Disclosure 17643 (December 1978), section III). Alternatively or additionally, reduction sensitization may be performed by adding reducing agents (tin(II) salts, amines, hydrazine derivatives, aminoboranes, silanes, formamidinesulphinic acid), by hydrogen, by low pAg (for example, less than 5) and/or high pH (for example, greater than 8).

The photographic emulsions may contain compounds to prevent fogging or to stabilize photographic function during production, storage or photographic processing.

Particularly suitable are azaindenes, preferably tetra- and pentaazaindenes, particularly those substituted with hydroxyl or amino groups. Such compounds have been described, for example, by Birr, Z. Wiss. Phot., 47, (1952), pages 2–58. Furthermore, salts of metals such as mercury or cadmium, aromatic sulphonic or sulphinic acids such as benzenesulphinic acid, or heterocyclics containing nitrogen such as nitrobenzimidazole, nitroindazole, optionally substituted benzotriazoles or benzothiazolium salts may also be used as anti-fogging agents. Particularly suitable are heterocyclics containing mercapto groups, for example mercaptobenzothiazoles, mercaptobenzimidazoles, mercaptotetrazoles, mercaptothiadiazoles, mercapto-pyrimidines, wherein these mercaptoazoles may also contain a water solubilising group, for example a carboxyl group or sulpho group. Further suitable compounds are published in Research Disclosure 17643 (December 1978), section VI.

The stabilizers may be added to the silver halide emulsions before, during or after ripening thereof. Naturally, the compounds may also be added to other photographic layers which are associated with a silver halide layer.

Mixtures of two or more of the stated compounds may also be used.

The photographic emulsions of the layers containing colour coupler may be spectrally sensitized by using methine dyes or other dyes. Particularly suitable dyes are cyanine dyes, merocyanine dyes and complex merocyanine dyes.

A review of the polymethine dyes suitable as spectral sensitizers, suitable combinations thereof and combinations with supersensitizing effects is contained in Research Disclosure 17643 (December 1978), section IV.

In particular, the following dyes—classified by spectral range—are suitable:

1. As Red Sensitizers 9-ethylcarbocyanines with benzothiazole, benzoselenazole or naphthothiazole as basic terminal groups, which may be substituted in 5th or 6th position by halogen, methyl, methoxy, carbalkoxy, aryl, together with 9-ethyl-naphthoxathia- or -selenocarbocyanines and 9-ethyl-naphthothiaoxa- or -benzoimidazocarbocyanines, provided that the dyes bear at least one sulphoalkyl group on the heterocyclic nitrogen.

2. As Green Sensitizers 9-ethylcarbocyanines with benzoxazole, naphthoxazole or a benzoxazole and a benzothiazole as basic terminal groups, together with benzimidazolecarbocyanines, which may also be further substituted and must also contain at least one sulphoalkyl group on the heterocyclic nitrogen.

3. As Blue Sensitizers symmetrical or asymmetrical benzimidazo-, oxa-, thia- or selenocyanines with at least one sulphoalkyl group on the heterocyclic nitrogen and optionally further substituents on the aromatic ring, together with apomerocyanines with a rhodanine group.

Sensitizers may be dispensed with if the intrinsic sensitivity of the silver halide is adequate for a specific range of the spectrum, for example the blue sensitivity of silver bromides.

The differently sensitized emulsion layers are, as explained at the beginning, associated with non-diffusing monomeric or polymeric colour couplers.

Colour couplers to produce the cyan partial colour image are generally couplers of the phenol or α-naphthol type.

Colour couplers to produce the magenta partial colour image are generally couplers of the 5-pyrazolone, indazolone or pyrazoloazole type.

Colour couplers to produce the yellow partial colour image are generally couplers with an open-chain ketomethylene grouping, in particular couplers of the α-acylacetamide type; suitable examples of these couplers are α-benzoylacetanilide couplers and α-pivaloylacetanilide couplers.

The colour couplers may be 4-equivalent couplers, but also 2-equivalent couplers. The latter are differentiated from 4-equivalent couplers by containing a substituent at the coupling site which is eliminated on coupling.

High molecular weight colour couplers are, for example, described in DE–C-1 297 417, DE-A-24 07 569, DE-A-31 48 125, DE-A-32 17 200, DE-A-33 20 079, DE-A-33 24 932, DE-A-33 31 743, DE-A-33 40 376, EP-A-27 284, U.S. Pat. No. 4,080,211. The high molecular weight colour couplers are generally produced by polymerization of ethylenically unsaturated monomeric colour couplers. They may, however, also be produced by polyaddition or polycondensation.

The incorporation of couplers or other compounds into silver halide emulsion layers may proceed by initially producing a solution, dispersion or emulsion of the compound concerned and then adding it to the coating solution for the layer concerned. Selection of the appropriate solvent or dispersant depends on the particular solubility of the compound.

Methods for the introduction of compounds which are essentially insoluble in water by a grinding process are described, for example, in DE-A-26 09 741 and DE-A-26 09 742.

Hydrophobic compounds may also be introduced into the coating solution by using high-boiling solvents, so-called oil formers.

Corresponding methods are described, for example, in U.S. Pat. No. 2,322,027, U.S. Pat. No. 2,801,170, U.S. Pat. No. 2,801,171 and EP-A-0 043 037.

Oligomers or polymers, so-called polymeric oil formers, may be used instead of high-boiling solvents.

The compounds may also be introduced into the coating solution in the form of loaded latices. Reference is, for example, made to DE-A-25 41 230, DE-A-25 41 274, DE-A-28 35 856, EP-A-0 014 921, EP-A-0 069 671, EP-A-0 130 115, U.S. Pat. No. 4,291,113.

The non-diffusible inclusion of anionic water-soluble compounds (for example dyes) may also proceed with the assistance of cationic polymers, so-called mordanting polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethylhexyl phthalate, decyl phthalate, triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphate, 2-ethylhexyl benzoate, dodecyl benzoate, 2-ethylhexyl-p-hydroxybenzoate, diethyldodecanamide, N-tetradecylpyrrolidone, isostearyl alcohol, 2,4-di-t-amylphenol, dioctyl acelate, glycerol tributyrate, iso-stearyl lactate, trioctyl citrate, N,N-dibutyl-2-butoxy-5-t-octyl aniline, paraffin, dodecyl- benzene and diisopropylnaphthalene.

Each of the differently sensitized photosensitive layers may consist of a single layer or may also comprise two or more partial layers of silver halide emulsion. In colour photographic silver halide materials according to the invention the blue-sensitive, yellow-coupling layer is applied first to the support, then the green-sensitive, magenta-coupling layer and finally the red-sensitive, cyan-coupling layer in a preferred embodiment.

The non-photosensitive interlayers generally located between layers of different spectral sensitivity may contain in addition to the compounds according to the invention agents which prevent an undesirable diffusion of developer oxidation products from one photosensitive layer into another photosensitive layer with a different spectral sensitization.

Suitable agents, which are also known as scavengers or DOP scavengers, are described in Research Disclosure 17 643 (December 1978), section VII, 17 842 (February 1979) and 18 716 (November 1979 ), page 650 and in EP-A-0 069 070, 0 098 072, 0 124 877, 0 125 522.

If there are several partial layers of the same spectral sensitization, then they may differ in composition, particularly in terms of the type and quantity of silver halide grains. In general, the partial layer with the greater sensitivity will be located further from the support than the partial layer with lower sensitivity. Partial layers of the same spectral sensitization may be adjacent to each other or may be separated by other layers, for example layers of different spectral sensitization.

Preferably, the material according to the invention contains only one blue-, one green- and one red-sensitive silver halide emulsion layer which contain the complementary couplers.

The photographic material may also contain UV light absorbing compounds, optical whiteners, toothing agents, filter dyes, formalin scavengers, light stabilizers, anti-oxidants, $D_{min}$ dyes, additives to improve stabilization of dyes, couplers and whites and to reduce colour fogging, plasticisers (latices), biocides and others.

The layers of the photographic material according to the invention may be hardened with customary hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen U.S. Pat. No. 3,288,775, U.S. Pat. No. 2,732,303, GB-A-974,723 and GB-A-1,167,207), divinylsulphone compounds, 5-acetyl-1, 3-diacryloylhexahydro-1,3,5-triazine and other compounds containing a reactive olefin bond (U.S. Pat. No. 3,635,718, U.S. Pat. No. 3,232,763 and GB-A-994,869); N-hydroxymethylphthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide type U.S. Pat. No. 3,100,704); carbamoylpyridinium salts (DE-A-22 25 230 and DE-A-24 39 551); carbamoyloxypyridinium compounds (DE-A-24 08 814); compounds with a phosphorus-halogen bond (JP-A-113 929/83); N-carbonyloximide compounds (JP-A-43353/81); N-sulphonyloximido ompounds (U.S. Pat. No. 4,111,926), dihydroquinoline compounds (U.S. Pat. No. 4,013,468), 2-sulphonyloxypyridinium salts (JP-A-110 762/81), formamidinium salts (EP-A-0 162 308), compounds with two or more N-acyloximino groups (U.S. Pat. No. 4,052,373), epoxy ompounds (U.S. Pat. No. 3,091, 537), compounds of the isoxazole type (U.S. Pat. No. 3,321,313 and U.S. Pat. No. 3,543,292); halogen carboxyaldehydes, such as mucochloric acid; dioxane derivatives, such as dihydroxydioxane and dichlorodioxane; and inorganic hardeners such as chrome alum and zirconium sulphate.

Hardening may be effected in a known manner by adding the hardener to the coating solution for the layer to be hardened, or by overcoating the layer to be hardened with a layer containing a diffusible hardener.

There are included in the classes listed slow acting and fast acting hardeners as well as so-called instant hardeners, which are particularly advantageous. Instant hardeners are taken to be compounds which harden suitable binders in such a way that immediately after coating, at the latest after 24 hours, preferably at the latest after 8 hours, hardening is concluded to such an extent that there is no further alteration in the sensitometry and swelling of the layered structure determined by the crosslinking reaction. Swelling is taken to be the difference between the wet layer thickness and the dry layer thickness during aqueous processing of the film (Photogr. Sci. Eng. 8 (1964), 275; Photogr. Sci. Eng. (1972), 449).

These hardeners which react very rapidly with gelatine are, for example, carbamoylpyridinium salts, which are capable of reacting with the free carboxyl groups of the gelatine, so that the latter react with free amino groups of the gelatine to form peptide bonds crosslinking the gelatine.

There are diffusible hardeners which have the same hardening effect on all the layers in a layered structure. There are, however, also non-diffusing low molecular weight and high molecular weight hardeners the action of which is restricted within a layer. Using these, individual layers, for example the protective layer, may be particularly highly crosslinked. This is important if the silver halide layer is sparingly hardened in order to increase the silver covering power and the mechanical properties of the protective layer must be improved (EP-A-0 114 699).

The colour photographic materials according to the invention are customarily processed by developing, bleaching, fixing and rinsing or by developing, bleaching, fixing and stabilising without subsequent rinsing, wherein bleaching and fixing may be combined into a single processing stage. Colour developer compounds which may be used are all developer compounds having the ability to react, in the form of their oxidation product, with colour couplers to azomethine or indophenol dyes. Suitable colour developer compounds are aromatic compounds containing at least one primary amino group of the p-phenylenediamine type, for example N,N-dialkyl-p-pheneylenediamines such as N,N-diethyl-p-phenylenediamine, 1-(N-ethyl-N-methane-sulphonamidoethyl)- 3-methyl-p-phenylenediamine, 1-(N-ethyl-N-hydroxyethyl)- 3-methyl-p-phenylenediamine and 1-(N-ethyl-N-methoxyethyl)- 3-methyl-p-phenylenediamine.

Further usable colour developers are, for example, described in J. Amer. Chem. Soc. 73, 3106 (1951) and G. Haist Modern Photographic Processing, 1979, John Wiley & Sons, New York, pages 545 et seq.

An acid stop bath or rinsing may follow after colour development.

Customarily, the material is bleached and fixed immediately after colour development. Bleaches which may be used are, for example, Fe(III) salts and Fe(III) complex salts such as ferricyanides, dichromates, water soluble cobalt complexes. Iron(III) complexes of aminopolycarboxylic acids are particularly preferred, in particular for example complexes of ethylenediaminetetraacetic acid, propylene-diaminetetraacetic acid, diethylenetriaminepentaacetic acid, nitrilotriacetic acid, iminodiacetic acid, N-hydroxyethylethylenediaminetriacetic acid, alkylimino-dicarboxylic acids and of corresponding phosphonic acids. Persulphates and peroxides, for example hydrogen peroxide, are also suitable as bleaches.

Rinsing usually follows the bleaching-fixing bath or fixing bath, which is performed as countercurrent rinsing or comprises several tanks with their own water supply.

Favourable results may be obtained by using a subsequent finishing bath which contains no or only a little formaldehyde.

Rinsing may, however, be completely replaced with a stabilising bath, which is customarily performed countercurrently. If formaldehyde is added, this stabilising bath also performs the function of a finishing bath.

Colour photographic negative materials may also be processed using a colour intensification process as described in Research Disclosure 34848 (1993).

EXAMPLES

A colour photographic recording material suitable for rapid processing was produced by applying the following layers in the stated sequence to a paper coated on both sides with polyethylene. The stated quantities relate in each case to 1 $m^2$. The corresponding quantity of $AgNO_3$ is stated for the quantity of silver halide applied.

EXAMPLE 1 (Comparison)

1st Layer (Substrate Layer)

0.2 g gelatine

2nd Layer (Blue-Sensitive Layer)

Blue-sensitive silver halide emulsion (99.5 mol. % chloride, 0.5 mol. % bromide, average grain diameter 0.85 μm) prepared from 0.50 g $AgNO_3$, sensitization maximum 480 nm, with 1.38 g gelatine 0.60 g yellow coupler Y-1

0.48 g tricresyl phosphate (TCP)

3rd Layer (Interlayer)

1.18 g gelatine 0.08 g 2,5-dioctylhydroquinone 0.08 g dibutyl phthalate (DBP)

4th Layer (Green-Sensitive Layer)

Green-sensitised silver halide emulsion (99.5 mol. % chloride, 0.5 mol. % bromide, average grain diameter 0.50 μm) prepared from 0.40 g $AgNO_3$, sensitization maximum 545 nm, with 1.02 g gelatine 0.37 g magenta coupler M-1

0.40 g DBP

5th Layer (Interlayer)

1.20 g gelatine 0.66 g UV absorber of the formula

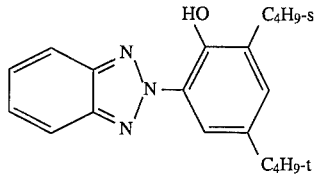

0.05 g 2,5-dioctylhydroquinone 0.36 g TCP

6th Layer (Red-Sensitive Layer)

Red-sensitised silver halide emulsion (99.5 mol. % chloride, 0.5 mol. % bromide, average grain diameter 0.50 μm) prepared from 0.28 g $AgNO_3$, sensitization maximum 708 nm, with 0.84 g gelatine 0.39 g cyan coupler C-1

0.39 g TCP

7th Layer (UV Protective Layer)

0.65 g gelatine 0.21 g UV absorber as in 5th layer 0.11 g TCP

8th Layer (Protective Layer)

0.65 g gelatine 0.39 g hardener of the formula

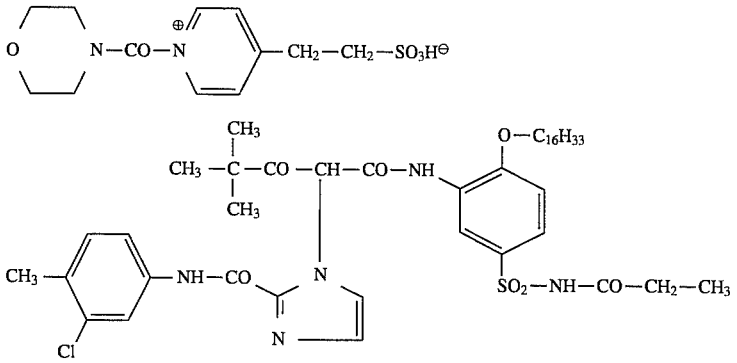

Y-1

-continued

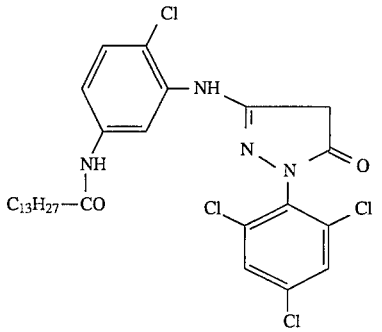

M-1

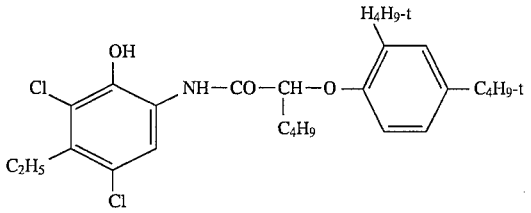

C-1

EXAMPLE 2 (Invention)

A colour photographic recording material was produced differing from the material stated in example 1 in the following details:

3rd Layer (Interlayer)

Additionally contains a silver halide emulsion (99.5 mol. % chloride, 0.5 mol. % bromide, average grain diameter 0.30 μm) prepared from 0.13 g $AgNO_3$; sensitized with S-4 ($\lambda_{max}$=605 nm)

0.003 g DIR-3

0.08 g gelatine 0.006 g DBP

5th Layer (Interlayer)

Additionally contains a silver halide emulsion (99.5 mol. % chloride, 0.5 mol. % bromide, average grain diameter 0.30 μm) prepared from 0.13 g $AgNO_3$; sensitized with S-4

0.003 g DIR-3

0.08 g gelatine 0.006 g DBP

7th Layer (UV Protective Layer)

Additionally contains a silver halide emulsion (99.5 mol. % chloride, 0.5 mol. % bromide, average grain diameter 0.30 μm) prepared from 0.13 g $AgNO_3$; sensitized with S-4

0.003 g DIR-3

0.08 g gelatine 0.006 g DBP

EXAMPLE 3 (Invention)

A colour photographic recording material was produced differing from the material stated in example 1 in the following details:

5th Layer (Interlayer)

Additionally contains a silver halide emulsion (99.5 mol. % chloride, 0.5 mol. % bromide, average grain diameter 0.20 μm) prepared from 0.06 g $AgNO_3$; sensitized with S-4

0.003 g DIR-3

0.06 g gelatine 0.006 g DBP

7th Layer (UV Protective Layer)

Additionally contains a silver halide emulsion (99.5 mol. % chloride, 0.5 mol. % bromide, average grain diameter 0.20 μm) prepared from 0.08 g $AgNO_3$; sensitized with S-4

0.005 g DIR-3

0.11 g gelatine 0.01 g DBP

The products of examples 1 to 3 are a) given a diffuse exposure of 1 second with white light through an interference filter (maximum transmission at 605 nm) and then b) exposed with white light through a step wedge, a barrier filter ($\lambda_{max}$=605 nm with a half-width of 60 nm) and magenta and yellow correcting filters such that a neutral grey is produced on the material over the entire density range after processing using the process stated below.

Gradation is measured in the density range between D=0.2 and D=1.0, denoted by $\gamma^I$ below and between D=1.0 and D=1.8, denoted by $\gamma^{II}$ below.

The following gradations are found in the processed sample (y=yellow; m=magenta; c=cyan):

| | $\gamma^I$ | | | $\gamma^{II}$ | | |
|---|---|---|---|---|---|---|
| Example | y | m | c | y | m | c |
| 1 | 1.85 | 1.96 | 1.82 | 3.77 | 3.91 | 4.00 |
| 2 | 1.59 | 1.69 | 1.58 | 3.33 | 3.66 | 3.65 |
| 3 | 1.69 | 1.77 | 1.62 | 3.45 | 3.79 | 3.44 |

By way of comparison, the products of examples 1 to 3 are exposed with white light through a step wedge, a barrier filter ($\lambda_{max}$=605 nm) and magenta and yellow correcting filters such that a neutral grey is produced on the material over the entire density range after processing using the stated process.

The following gradations are found in the processed samples:

| | $\gamma^{I}$ | | | $\gamma^{II}$ | | |
|---|---|---|---|---|---|---|
| Example | y | m | c | y | m | c |
| 1 | 1.83 | 1.91 | 1.79 | 3.70 | 3.91 | 3.90 |
| 2 | 1.82 | 1.89 | 1.75 | 3.70 | 3.88 | 3.86 |
| 3 | 1.82 | 1.90 | 1.75 | 3.70 | 3.89 | 3.85 |

The example shows that, due to the diffuse exposure at $\lambda$=605 nm, the material according to the invention (examples 2 and 3) exhibits distinctly flatter gradation.

The above-described exposure is repeated with the same light source, but the exposure time with white light is reduced to 0.1 second.

| | $\gamma^{I}$ | | | $\gamma^{II}$ | | |
|---|---|---|---|---|---|---|
| Example | y | m | c | y | m | c |
| 1 | 1.86 | 1.98 | 1.86 | 3.81 | 3.91 | 4.06 |
| 2 | 1.72 | 1.88 | 1.76 | 3.59 | 3.77 | 3.80 |
| 3 | 1.79 | 1.90 | 1.81 | 3.70 | 3.85 | 3.61 |

The comparison shows that a weaker diffuse exposure at 605 nm brings about a steeper gradation of the examples according to the invention, which is, however, still flatter than in the comparison material.

The processing steps were carried out as follows:

| step | time | temperature |
|---|---|---|
| colour developer | 45 sec | 35° C. |
| bleach-fixing | 45 sec | 35° C. |
| washing | 90 sec | 33° C. |

The composition of the processing solutions were given below.

| Colour developer solution | |
|---|---|
| Tetraethylene glycol | 20,0 g |
| N,N-Diethylhydroxylamine | 4,0 g |
| (N-ethyl-N-(2-methanesulphonamido)ethyl))-4-amino-3-methyl-benzene sulfate | 5,0 g |
| Potassium sulfite | 0,2 g |
| Potassium carbonate | 30,0 g |
| Polymaleinic acid anhydride | 2,5 g |
| Hydroxyethanediphosphonic acid | 0,2 g |
| Fluorescent whitening agent, (a 4,4'-diaminostilbene-sulfonic acid derivative) | 2,0 g |
| Potassium bromide | 0,02 g |
| add water to make 1000 mL, adjust pH with KOH or $H_2SO_4$ to be pH 10,2. | |
| **Bleach-fixing solution** | |
| Ammonium thiosulfate | 75,0 g |
| Sodium hydrogensulfite | 13,5 g |
| Ethylenediaminetetraacetic acid (Ferric-ammonium-salt) | 45,0 g |
| add water to make 1000 mL, adjust pH with ammonium hydroxide solution (25%) or acetic acid to be pH 6,0. | |

c) Rinsing—2 min—33° C.

d) Drying

We claim:

1. Color photographic silver halide print material which comprises on a support at least one blue-sensitive silver halide emulsion layer containing at least one yellow coupler, at least one green-sensitive silver halide emulsion layer containing at least one magenta coupler, at least one red-sensitive silver halide emulsion layer containing at least one cyan coupler and at least one control layer containing no color coupler said control layer containing a silver halide control emulsion sensitized in the range from 570 to 690 nm or in the range above 730 nm and a substance A, which, on color negative development of the control emulsion, releases a compound B which alters the gradation of at least one layer containing color coupler.

2. Color photographic silver halide material according to claim 1, wherein the control layer is located further from the support than each of the blue-, green- and red-sensitive coupler-containing silver halide emulsion layers.

3. Color photographic silver halide material according to claim 1, wherein the control layer is located closest to the support than each of the blue-, green- and red-sensitive coupler containing silver halide emulsion layers.

4. Color photographic silver halide material according to claim 1, wherein the control layer is located between two light-sensitive coupler-containing silver halide emulsion layers.

5. Color photographic silver halide material according to claim 1, comprising more than one control layer.

6. Color photographic silver halide material according to claim 1, wherein substance A has a reaction rate constant with the developer oxidation product ≧30,000 {l/mol·s} and the substance B has a diffusibility of ≧0.4.

7. Color photographic silver halide material according to claim 1, wherein substance A is one of the formulae I or II

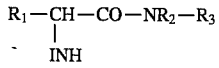

(I)

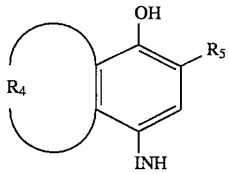

(II)

INH means the residue of compound B bonded via an N atom, via an S atom or via time control member, $R_1$ means a residue $R_3$—CO—, $R_3$—$NR_2$—CO—, $R_6$CO—$NR_2$—$NR_2$—CO—,

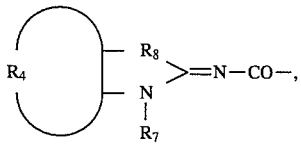

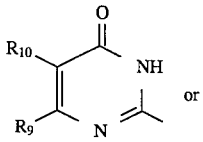

or

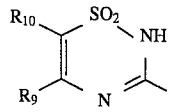

$R_2$ means hydrogen, alkyl, aralkyl or alkylene attached to an adjacent aromatic residue, $R_3$ means an unsubstituted or substituted aromatic carbocyclic or heterocyclic residue, $R_4$ means the atoms necessary to complete an aromatic or heterocyclic residue, $R_5$ means a substituent with a Hammett constant $\sigma_{meta}$ of at least 0.1, $R_6$ means alkyl, aryl aralkyl, alkoxy, alkylamine, arylamino or aralkylamino, $R_7$ means alkyl, aryl or aralkyl, $R_8$ means —$NR_2$— or —S—, $R_9$ and $R_{10}$ are the same or different and mean hydrogen, alkyl, aryl, alkoxy, alkylcarbonyl, arylcarbonyl, alkylsulphonyl, arylsulphonyl or $R_9$ and $R_{10}$ together denote $C_3$–$C_5$ alkylene or $R_9$ and $R_{10}$ together form the remaining members of an aromatic carbocyclic or heterocyclic ring.

8. The color-photographic silver halide material according to claim 1, wherein compound A is of the formula III

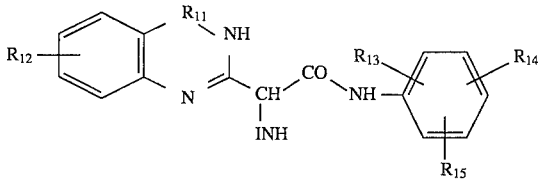

$R_{11}$ means —CO—, or —$SO_2$—, $R_{12}$ means hydrogen, halogen, $C_1$–$C_4$ alkyl or $C_1$–$C_4$ alkoxy, $R_{13}$, $R_{14}$ and $R_{15}$ are the same or different and mean hydrogen, halogen, alkyl, aryl, alkoxy, aryloxy, alkythio, arylthio, sulphonamido, sulphamoyl, carbamoyl, acrylamino, ureido, aminocarbonyloxy, sulphonyl or a ballast residue and at least one of the substitutents $R_{13}$, $R_{14}$ and $R_{15}$ is the ballast residue.

9. The color photographic silver halide material according to claim 7, wherein the control emulsion is used in a total quantity of 0.001 to 2.0 mmol/$m^2$ per control layer and compound A is used in a total quantity of 0.0005 to 1.0 mmol/$m^2$ per control layer.

10. The color photographic material according to claim 1, containing 3 control layers.

11. The color photographic material according to claim 1, with a total quantity of silver halide, stated as the equivalent quantity of $AgNO_3$, of at most 1 g/$m^2$.

12. The color photographic silver halide material according to claim 7, wherein INH means the residue from the series of mono- or bicyclic triazoles or of mercapto 1,2,4-thia-diazoles and $R_5$ is a carbonamido or carbamoyl group.

13. The color photographic silver halide material according to claim 1, wherein said control layer is sentized in the range from 580 to 680 nm or 740 to 800 nm.

* * * * *